United States Patent [19]

Bochert

[11] 4,364,321

[45] Dec. 21, 1982

[54] FABRIC TOP FEEDER FOR A SEWING MACHINE

[75] Inventor: Hubertus Bochert, Steinhagen, Fed. Rep. of Germany

[73] Assignee: Dürkoppwerke GmbH, Bielefeld, Fed. Rep. of Germany

[21] Appl. No.: 303,598

[22] Filed: Sep. 18, 1981

[30] Foreign Application Priority Data

Sep. 20, 1980 [DE] Fed. Rep. of Germany ..... 3035540

[51] Int. Cl.[3] ..... D05B 27/06

[52] U.S. Cl. ..... 112/311; 112/220

[58] Field of Search ..... 112/311, 320, 303, 314, 112/220

[56] References Cited

U.S. PATENT DOCUMENTS

| | | | |
|---|---|---|---|
| 2,966,810 | 1/1961 | Hayes | 112/220 X |
| 3,095,765 | 7/1963 | Perla | 112/220 X |
| 3,196,815 | 7/1965 | Von Hagen | 112/311 |
| 3,605,662 | 9/1971 | Willenbacher et al. | 112/311 |

FOREIGN PATENT DOCUMENTS

| | | | |
|---|---|---|---|
| 1061603 | 7/1959 | Fed. Rep. of Germany | 112/311 |
| 1750498 | 5/1968 | Fed. Rep. of Germany | 112/311 |

*Primary Examiner*—H. Hampton Hunter
*Attorney, Agent, or Firm*—Karl F. Ross

[57] ABSTRACT

A fabric workpiece fed along the worktable of a sewing machine by the intermittent movement of the fabric-advance dogs operating through openings in the worktable, is also engaged by an intermittently rotated feed wheel above the worktable. The stepwise rotary movement, whose stepping angle can be varied in a stepless manner, is imparted to the wheel by the output element of a planetary-gear transmission, one input of which is connected to a stepless transmission while the other input is connected to a crank drive with a steplessly variable output-oscillation angle establishing a dwell period.

9 Claims, 5 Drawing Figures

FABRIC TOP FEEDER FOR A SEWING MACHINE

FIELD OF THE INVENTION

My present invention relates to a fabric feed mechanism for a sewing machine and, more particularly, to a top feeder engageable with workpieces from above for ensuring uniform advance of a fabric past the needle position of a sewing machine.

BACKGROUND OF THE INVENTION

A sewing machine generally comprises a worktable overhung by an arm from the head or working end of which a presser foot is resiliently mounted and in which a needle bar is reciprocatable to periodically thrust the needle through a fabric advanced across this worktable over a stitching plate to form a row of stitches in the fabric.

The worktable is provided with a hole through which the needle can pass and windows or openings through which dogs, driven by a mechanism below the worktable and synchronized with the needle through which the intermittent movement of the dogs can advance the fabric by engagement with the underside of the workpiece.

Thus, while the dogs, which can have teeth or other formations along the upper surface to positively grip the underlying fabric layer, tend to remove this underlying fabric layer in the direction of advance of the workpiece, the upper layer of the latter is frictionally engaged by the presser foot and may be relatively retarded.

It has been found that the positive advance of the lower layer, coupled with retardation of the upper layer, can result in irregular stitch formation, in wrinkling, in bunching and even in relative offsetting of the upper and lower layers so that they may be disaligned or rendered noncoextensive.

To prevent such relative shifting of the layers of a workpiece it has already been proposed to provide an upper feed member which engages the upper layer and is intended to advance the latter synchronously with the advance of the lower layer by the dogs. In German Pat. No. 10 61 603, for example, this upper member is an intermittently rotated feed roller or wheel connected to a mechanism for stepping the rotation of the wheel or roller synchronously with the movement of the feed dogs.

A difficulty with such systems, however, is that the stepping rotation of this wheel or roller is not adjustable as to angular velocity, stepping angle and like parameters as is important for high versatility of the mechanism.

In other fields it is known to provide transport rollers which are angularly oscillated and in which the angular or stepping displacement, represented by the angle $\alpha$ can be steplessly varied during the running of a sewing machine.

In earlier systems of this type, there were a number of problems. For example, when the feed roller was driven by a crank drive, the intermittent movement was generally transmitted to the roller from the crank drive by an undirectional clutch allowing the crank to return after each stroke, this unrotational clutch or like member being provided with a brake. The purpose of the brake was to prevent, at high sewing speeds, an overrotation during the return stroke so as to ensure, to the greatest extent possible, a constant stepping angle $\alpha$ of the mechanism. This brake, however, introduced a drag to the system which increased the power requirements and decreased efficiency.

Another disadvantage of the earlier systems described was the result of inertial forces which, at high sewing rates and/or with relatively great stitch length and hence fabric advance steps resulted in an increasing overrun even when the brake was provided. This overrun tended to increase still further during long periods of operation and resulted in a noticeable decrease in sewing quality and output.

German patent document 17 50 498 discloses a transmission or drive for a rotary member engageable with the fabric on a sewing machine table which superimposes an oscillating angular displacement upon a continuous rotary displacement but without any possibility of stepless control of the stepping angle to compensate for variation in stitch length and the degree of advance by the feed mechanism below the work table, during operation of the sewing machine.

OBJECTS OF THE INVENTION

It is the principal object of the present invention to provide an improved system for driving a fabric for this roller in a sewing machine whereby disadvantages of earlier arrangements are obviated.

Another object of this invention is to provide a fabric feed mechanism including a roller engageable with the upper fabric layer on the worktable of a sewing machine which eliminates the need for a power-draining brake and yet permits accurate adjustment of the spring angle and speed of a feed roller without the danger of overrun characterizing earlier systems of the type described and thus utilizing similar principles.

SUMMARY OF THE INVENTION

These objects and others which will become apparent hereinafter are attained in accordance with the invention with a sewing machine having a worktable of the type described and, in addition to the usual oscillating dogs forming the lower fabric feed mechanism, an overhanging stitching arm, and reciprocatable needle bar and presser foot, a fabric feed roller engageable with an upper layer of a fabric workpiece adjacent the stitching location and angularly displaceable in a stepwise manner with the stepping angle being adjustable in a continuous or stepless manner.

According to the invention, the drive for the roller comprises a rotary drive with stepless or continuous speed control (i.e. continuous control of the ratio between input and output speeds of this transmission), a planetary-gear transmission having an output element connected to the roller and an input element connected to the stepless rotary transmission, and a crank transmission with a steplessly variable oscillating angle and connected to the other input element of the planetary gear transmission.

The planetary gear transmission can have any standard planetary gear configuration and will comprise, as is customary, a sun gear member, a planet carrier generally rotatable about an axis which can coincide with the axis of the sun gear member, this planet member carrying one or more planet gears meshing with the sun gear member, and a ring gear member meshing with the planet gears, one of the members serving as the output element while each of the other two members constitutes a respective one of the aforementioned input elements.

This system provides a steplessly variable stepping angle with a minimum tendency toward overrunning and an arrangement in which any overrunning is not dependent upon the stitching rate. The system is also free from drag and thus operates with a high degree of efficiency to provide smooth formation of the stitch seam without any tendency for the two fabric layers to shift relative to one another even with considerable stitch length.

According to another feature of the invention, the rotary transmission between the drive shaft of the sewing machine and the first mentioned input element of the planetary gear transmission is constituted as a belt drive with driving and driven pulleys interconnected by a belt any one of which can be adjustable at least to vary the effective peripheral speed of this pulley and thus the transmission ratio between them. Each pulley may be formed from a pair of frustoconical wheels capable of relative axial displacement, i.e. wherein one wheel of each pulley can be shifted axially relative to the other wheel thereof.

According to yet another feature of the invention, a rigid connection is provided between the intermediate shaft driven by the machine power source and the hub of one of the frustoconical wheels or discs while the juxtaposed wheel is urged axially by spring force toward the first mentioned wheel. Similarly, one of the wheels of the other pulley can be connected rigidly to a shaft, coupled with the first wheel input element of the planetary gear transmission while the other wheel on this shaft is spring biased and shiftable by an actuating lever.

Preferably the spring force supplied to the latter wheel or disk of this pulley is greater than the spring force applied to the spring biased wheel on the pulley of the intermediate shaft.

According to yet another feature of this invention, the first element of the planetary gear transmission is the sun wheel member and the planet carrier is connected, e.g. by a belt drive, with the fabric-feed roller. The ring gear is mounted in a housing for this planetary gear transmission and is connected to the crank drive. The crank drive itself can be a so-called six-element crank mechanism. For example, an eccentric on the main drive shaft or arm shaft of the sewing machine can act via a link upon an intermediate arm, one end of which is slidable while the other end is pivoted to a rocker. The slide body can, in turn, be shiftable in a slide shaft rotatable by an actuating mechanism so that the movement of the rocker can be transmitted via a transmission element to a lug rigid with the hollow shaft forming the aforementioned housing and ring gear.

The adjustment of the actuating mechanism is effected via a lever, a link and a further lever connected to the slide shaft and which acts upon a fork or other member for setting the transmission ratio of the rotary transmission.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
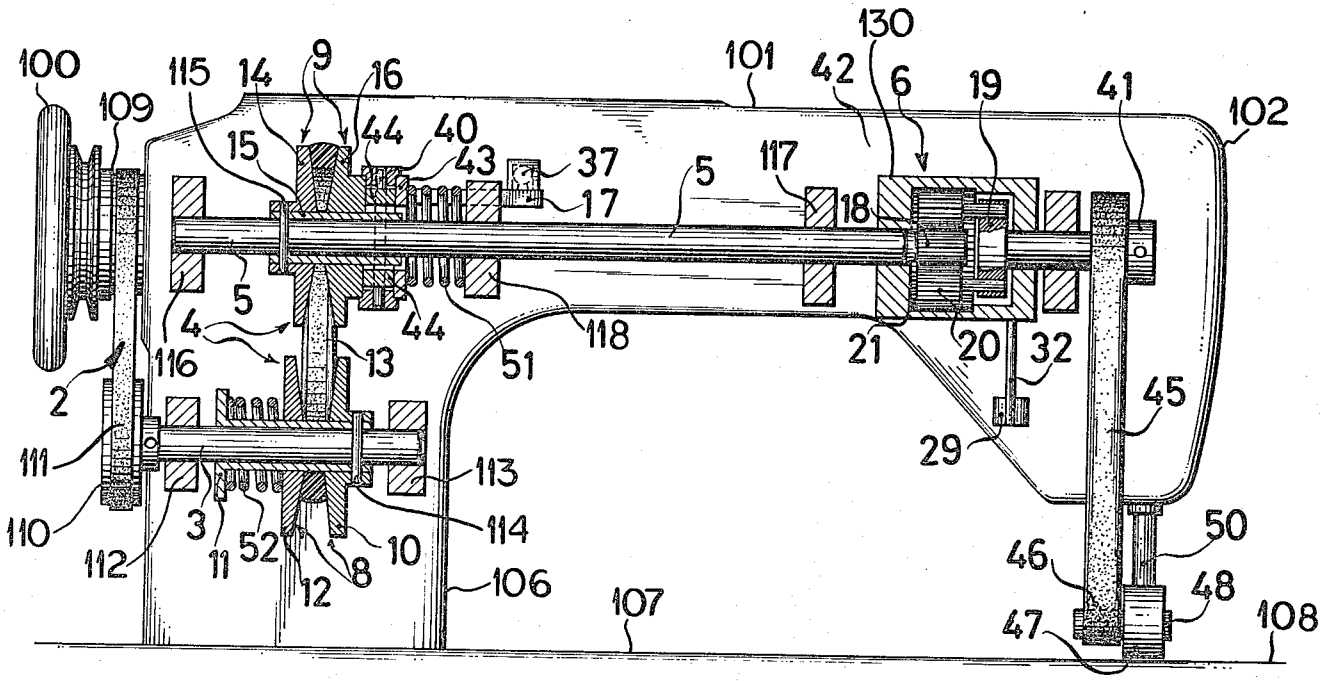
FIG. 1 is a cross sectional view through the mechanism disposed along the arm of a sewing machine shown only in outline form for driving a feed roller in accordance with the invention, the section corresponding to a section along the line A–B of FIG. 2.

In FIG. 1 I have shown the rear of an industrial type sewing machine which is equipped with a mechanism of the invention shown to be mounted on this rear side and broken away. The sewing machine itself is, of course, provided with conventional mechanisms which have not been illustrated or described but nevertheless will be present. For example, the machine comprises a hand wheel 100 connected to the main drive shaft (not shown) which extends through the arm 101 of the machine housing 42 to the head 102 at which it can drive the needle bar 103 (FIG. 4) by any conventional cam or like mechanism.

The needle bar carries a needle 104 which can pass through the fingers 105 of the presser foot 49 raised and lowered also by a conventional mechanism not shown on the head 102 via the rod 50.

The machine housing 42 comprises a post 106 at its end opposite the head 102 and mounted upon a stand 107 forming a worktable 108 along which the fabric is displaced for sewing a seam thereon.

Also not shown, but always present in the sewing machine of the invention, is a stitching plate disposed below the needle 104 and provided with a hole through which the needle can pass, in the plane of the table 107. The stitching plate can be movable to allow access to a bobbin, bobbin holder and/or stitch-forming mechanism below the stitching plate.

The table 108 is also formed with windows through which conventional dogs can oscillate upwardly and forwardly to engage the underside of the fabric workpiece or layer on the worktable, these dogs being operated by a conventional mechanism and shaft coupled with the hand wheel and the arm shaft to ensure synchronous movement of the dogs and the needle bar.

The mechanism shown in FIG. 1 comprises a belt transmission 2 for driving an intermediate shaft 3. Since synchronism is important in this mechanism, the belt transmission 2 can be of the toothed type, i.e. the pulley 109 coupled with the hand wheel and the main shaft can be a cog wheel while the pulley 110 connected to the shaft 103 can likewise be a cog wheel, the belt 111 being a cog belt.

The shaft 3 is journaled in a pair of blocks 112 and 113 on the post 106 parallel to a shaft 5.

A continuously variable belt transmission generally represented at 4 rotationally couples the shafts 3 and 5.

This transmission includes a frustoconical wheel 10 angularly and axially fixed to the shaft 3 by a pin 114 which also locks a sleeve or hub 11 to this shaft and this wheel, another frustoconical wheel 12 being keyed to the sleeve 11, i.e. angularly affixed thereto, but axially displaceable on this sleeve and biased by a spring 52 to the right. The wheels 10 and 12 form a variable diameter pulley 8.

A V-belt 13 connects the pulley 8 with another variable diameter pulley 9.

The pulley 9 comprises a frustoconical wheel 14 which is connected by a pin 115 to a hub or sleeve 15 and the shaft 5 which is journaled in bearing blocks 116 and 117 on the rear of the arm 101.

The sleeve 15 is keyed to an axially displaceable wheel 16 which is urged by a spring 51 toward the wheel 14.

The spring 51 is seated against a body 118 rotatable with the shaft 5 and acts against a disc 43 provided with an annular channel 40 between two annular bulges 44 and into which the fingers of a pivotal fork lever 17 engage so that displacement of this lever 17 controls the effective diameter of the pulley 9 and varies the speed ratio between the two pulleys.

In the position of the belt 13 shown in FIG. 1, the shaft feeders driven with its minimum speed, i.e. the intermittently rotated feed roller 47 will be driven with a minimum stepping angle $\alpha$, i.e. the advance of the upper layer is at a minimum.

Figure 3:
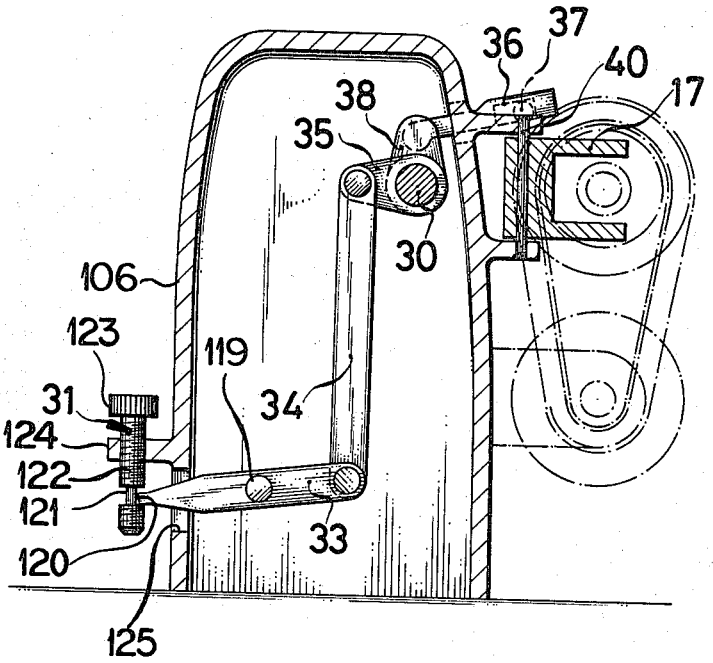
FIG. 3 is a section taken along the line C–D of FIG. 2.

To increase the stepping angle $\alpha$ the actuator 31 is adjusted (see FIG. 3) to displace the lever 33 in the clockwise sense. To this end, lever 33, which is fulcrumed at 119 in the post 106, has its free end formed as a finger 120 engaging in a groove 121 of the threaded shank 122 of the screw which forms the adjusting element 31. This screw can have a milled head 123 and can be threaded in a lug 124. On the post 106, the finger 120, passing through a slot 125 in this post to engage this adjusting element.

The lever 33 is pivotally connected to a link 34 which is drawn downwardly when lever 33 is rotated in the clockwise sense, to rotate a further lever 35 in the counterclockwise sense.

Figure 2:
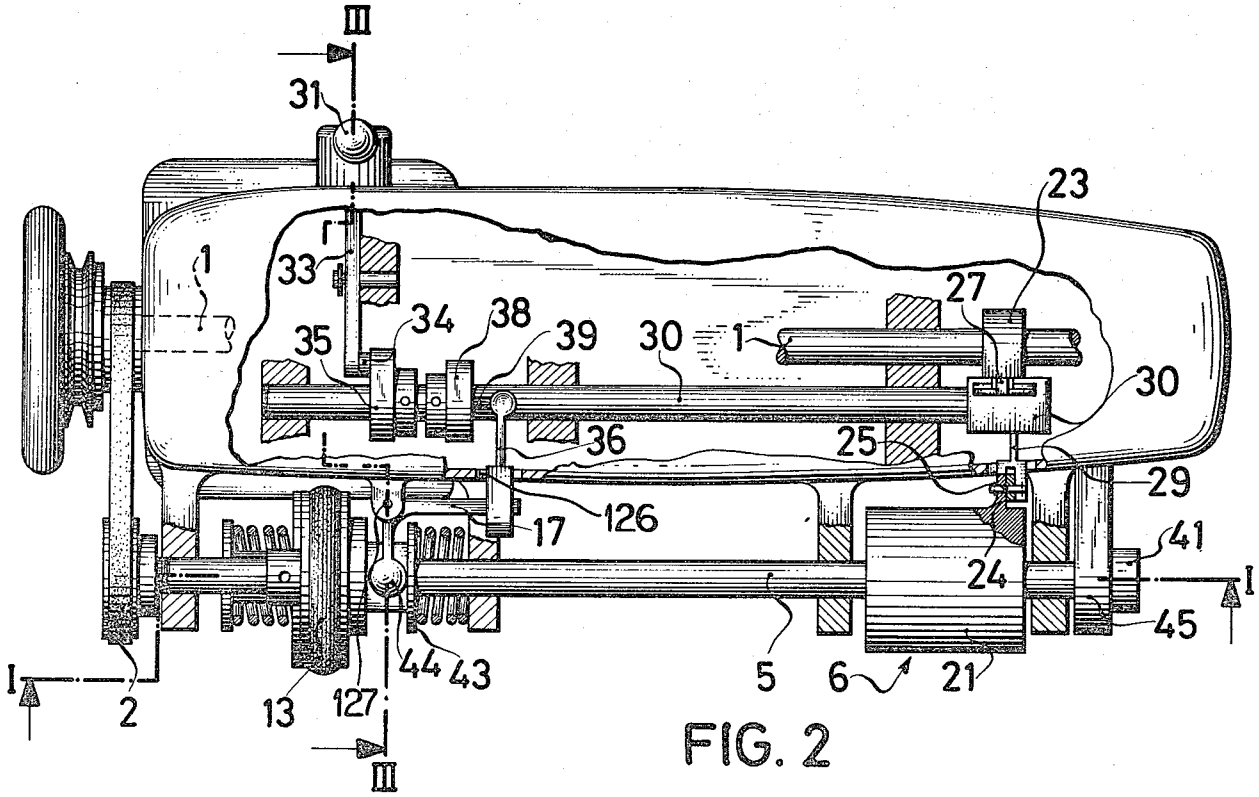
FIG. 2 is a plan view of this mechanism showing the arm and portions of the mechanism partly broken away.

To this end, the link 34 is pivotally connected to one arm to the belt crank lever 35 which is rotatable on the slide block shaft 30 and has its other arm 38 (or other lever connected to this shaft) linked by a ball joint 39 to a connecting member 36 passing through a slot 126 in the arm 101 (FIG. 2) to engage the fork lever 17 which is fulcrumed at 127 to this arm 101. A ball joint 27 on this lever 17 engages in the underside of the connecting member 36 so that tilting of the latter does not effect the displacement of the lever 17. The spring 51 ensures that the ball joint member 37 will bear against the forward edge of the recess in connecting member 36.

With this adjustment, the spring force 51 is held by the wheel 33 away from wheel 16 and the upper loop of the belt 13 can draw more deeply into the pulley 9 while the lower loop rides outwardly on the pulley 8. Thus the speed of the shaft 5 is increased as the effective diameter of pulley 9 decreases and the effective diameter of pulley 8 increases. The stepping angle $\alpha$ is thereby increased.

Conversely, the reduced stepping angle will result from a reverse adjustment of member 31 in which case the disc 43 will supplement the spring 51 in pressing against the wheel 16 and tend to urge the upper loop of the belt 13 into its larger effective diameter. Of course, the disc 43 can merely relieve the spring 51 which can be of greater force than spring 52 so that the adjustment mechanism need only introduce some play to permit the spring adjustment of the transmission in favor of the smaller stepping angle.

An end of the shaft 5 is formed as the sun gear 18 of a planetary gear transmission 6 which also includes a pair of planet gears 30 rotatable on a planet gear carrier 19 and meshing with both the sun gear 18 and a ring gear 21 formed on the interior of a housing 130.

Figure 4:
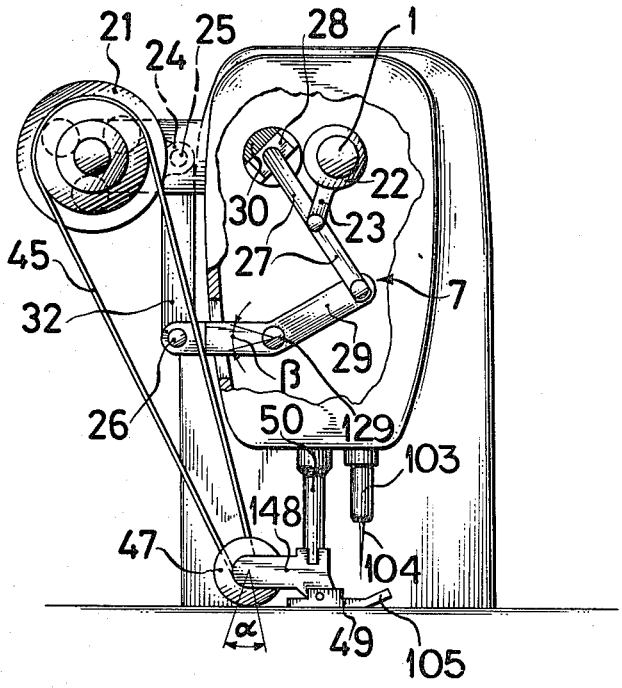
FIG. 4 is an end view partially broken away and in highly diagrammatic form illustrating the coupling of the mechanism to the feed roller.

The housing 130 is rigidly connected to a lug 24 which is oscillated by a crank drive 7 best seen in FIG. 4.

In this Figure, the arm shaft 1 is shown to carry an eccentric 22 connected by a bar 23 pivotally with a link 27, one end of which is swingable on a slide block 28 guided in a groove on the slide block shaft 30. The latter is rotatable within the arm and is connected to the levers 35 and 38 as previously mentioned. At its other end, the link 27 is pivotally connected to one end of a rocker 29 fulcrumed at 129 in the arm and pivotally connected at 26 to a further link 32 which is swingable at 25 on the aforementioned lug 24.

Upon adjustment of member 31, as has already been described for the pivoting of the lever 33, the movement of link 24 and the rotation of the shaft 30 with its lever 35, the angular displacement of the shaft 30 via the linkage 27, 29, 32 to swing the housing 130 and thereby establish the adjustable dwell angle $\beta$ of the rocker.

This angle $\beta$ represents the drive interruption angle and thus is applied directly to the ring gear.

Figure 5:
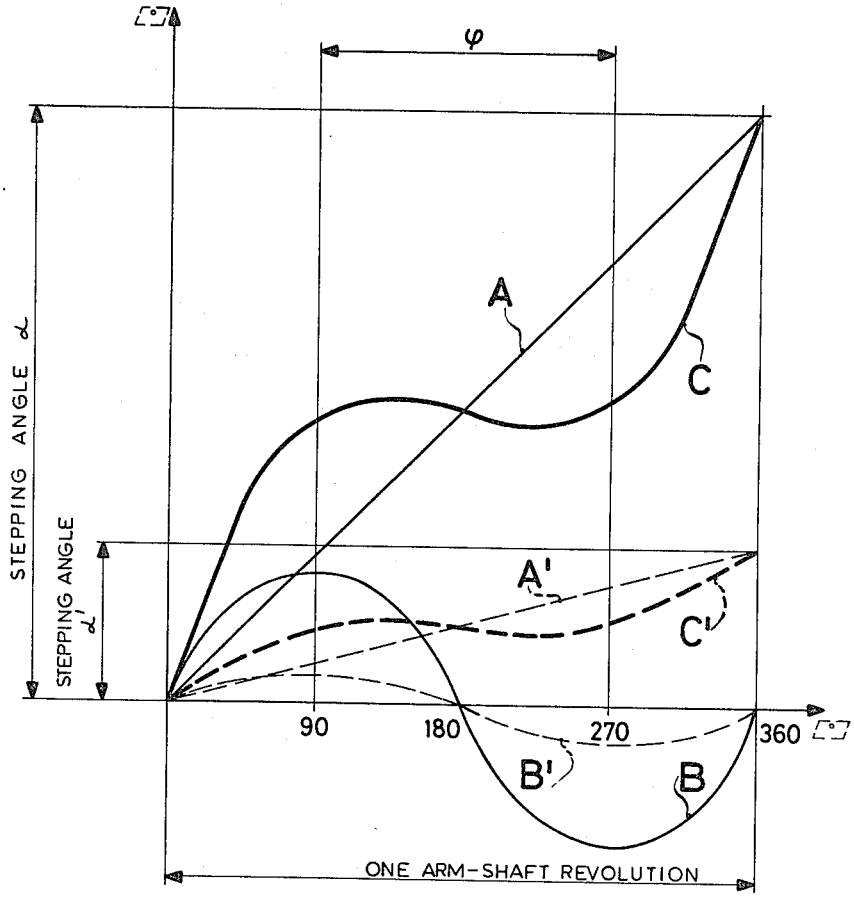
FIG. 5 is a motion diagram comparing one revolution of the arm shaft with the intermittent advance of the feed roller for various feed angles.

Thus, by the adjustment element 31 it is possible to vary the period of dwell represented by the angle $\beta$ and during which the feed roller 47 is practically at standstill while adjusting the stepping angle. In practice, this dwell angle will be substantially the same for all stepping angles and will correspond to the period in which the needle traverses the workpiece. This has been shown in FIG. 5 in which the stepping angle is plotted along the ordinate against angular displacement of the arm shaft along the abscissa.

Curves B and B′ represent the angular displacement which would be transmitted via the planetary gear transmission for a single revolution of the arm shaft and for different adjustments for stitch length.

The curve C thus represents the rotation of the feed wheel 47 when the angular displacement B is superimposed upon the straight line A representing the continuous arm shaft rotation.

Similarly, the curve C′ represents the rotation of the wheel 47 for the smaller stepping angle and is obtained by superimposition of the curve B′ on the straight line A′.

In both cases, practically equal standstill or dwell periods are obtained over the angle $\phi$ of approximately 180°, the needle passage through the workpiece occurring during this period.

The angular stepping of the wheel 40 is effected by a belt 45 passing over a pulley 46 on a shaft 48 which is mounted on an arm 148 projecting rearwardly from the presser foot and mounted therewith on the spring load presser bar 50 so that, when the latter is raised, the roller 47 is likewise raised and lifted from the workpiece.

It is also possible to provide the belt 45 as the means for displacing the upper layer fabric, in which case a roller provides jointly the fabric feeds function and the pulley function, the outer periphery of the belt engaging the fabric directly.

Other modifications of the invention within the limits of the appended claims can admit of a gear-type variable speed transmission in place of the transmission 4, and a four-element crank drive in place of the six-element crank mechanism 7 with variable eccentricity or throw.

With the system of the present invention any overrotation of the wheel can be held negligently small and a constant stepping angle can be obtained which is independent from the stitch-forming rate.

The system from the planetary gear inputs to the transport wheel or belt can be made to be slip free so that the intermittent motion is likewise slip free.

Since all of the elements from the input and the output are continuously engaged, breaks and the like can be avoided. The noise is also minimum and the system has been found to be effective for varying stitch angles with stitch cams of 4,000 to 4,500 stitches per minute.

I claim:

1. In a sewing machine having an arm shaft driving a needle bar to reciprocate a needle through a fabric workpiece at a stitching location and connected to a mechanism engageable with an underside of said workpiece for advancing same past said location, and a fabric feeder engageable with said workpiece from above to advance said workpiece, said feeder being provided with a mechanism connected to said shaft for imparting intermittent angular displacement thereto, the improvement wherein said mechanism comprises:

a steplessly variable transmission connected to said shaft;

a planetary gear transmission having three mutually interengaged elements including a first input element, a second input element and an output element;

means connecting said first input element to said steplessly variable transmission;

a crank drive connected to said second element for angularly oscillating same; and means connecting said output element to said fabric feeder, the adjustability of said steplessly variable transmission varying a stepping angle of said feeder and the throw of said crank drive controlling a dwell of said feeder.

2. The improvement defined in claim 1 wherein said steplessly variable transmission comprises a pair of pulleys, interconnected by a belt and having variable effective diameters, one of said pulleys being connected to said arm shaft, the other of said pulleys being connected to a further shaft, one of said elements being connected to said further shaft, each of said pulleys having an axially fixed disc and an axially shiftable disc.

3. The improvement defined in claim 2 wherein the pulley on said other shaft comprises a spring bearing axially on the axially movable disc thereof and adjustment means for relieving the force of said spring to enable variation in the effective diameters of said pulleys.

4. The improvement defined in claim 3 wherein another spring bears axially on the axially moving disc of the pulley connected to said arm shaft, the spring of the pulley of said other shaft having a greater force than the spring of the pulley connected to said arm shaft.

5. The improvement defined in claim 1 wherein said first element is a sun gear of said planetary gear transmission, said third element including a planet carrier having a pair of planet gears meshing with said sun gear, said second element including a ring gear meshing with said planet gears.

6. The improvement defined in claim 5 wherein said crank drive is a six-element crank drive connected to said ring gear for angularly oscillating same.

7. The improvement defined in claim 6 wherein said variable transmission has its transmission ratio adjustable at least in part in dependence upon the rotation of a slide-block shaft, said crank drive including a slide element radially slidable on said slide block shaft.

8. The improvement defined in claim 7, further comprising a link pivotally connected to said slide block, a rocker lever pivotally connected to said link and to said ring gear and an eccentric pivotally connected to said link on said arm shaft.

9. The improvement defined in claim 7 or claim 8, further comprising a screw manually adjustable on said machine, a lever engaged by said screw and link means connecting the latter lever to said slide block arm for rotating same.

* * * * *